United States Patent [19]

Applegate

[11] Patent Number: 4,953,623

[45] Date of Patent: Sep. 4, 1990

[54] PROTECTED L-SHAPED ENVIRONMENT USING SINGLE CHEMICAL NOZZLE

[75] Inventor: Donald W. Applegate, Jamesburg, N.J.

[73] Assignee: Pem All Fire Extinguisher Corporation, Cranford, N.J.

[21] Appl. No.: 324,386

[22] Filed: Mar. 16, 1989

[51] Int. Cl.[5] ..... A62C 37/10

[52] U.S. Cl. ..... 169/37

[58] Field of Search ..... 169/22, 37, 38, 39, 169/40, 41, 90

[56] References Cited

U.S. PATENT DOCUMENTS

| | | | |
|---|---|---|---|
| 4,213,567 | 7/1980 | McIntire | 169/37 |
| 4,296,816 | 10/1981 | Fischer | 169/37 |
| 4,351,393 | 9/1982 | Tyree | 169/37 |
| 4,610,310 | 9/1986 | Miller et al. | 169/37 |

*Primary Examiner*—Sherman D. Basinger
*Assistant Examiner*—Stephen P. Avila
*Attorney, Agent, or Firm*—Rohm & Monsanto

[57] ABSTRACT

An evironment which is protected from fire employs a nozzle arrangement having three discharge apertures for distributing a fire suppression fluid such as HALON. The environment is arranged in a predetermined area or space having an odd shape, such as an L-shape, and is adequately protected with a single nozzle arrangement. The nozzle arrangement is characterized by a chamber for receiving the fire suppression fluid at a rate of flow sufficient to supply the fire suppression fluid to the three apertures in conformance with applicable specifications, such as those established by Underwriters' Laboratories, Inc. The discharge apertures in the nozzle arrangement are in the form of through-holes arranged in the chamber wall. Preferably, the apertures are arranged at 90° increments around the chamber wall, whereby the fire suppression fluid is discharged in diametrically opposed directions, and orthogonal thereto.

7 Claims, 2 Drawing Sheets

PROTECTED L-SHAPED ENVIRONMENT USING SINGLE CHEMICAL NOZZLE

BACKGROUND OF THE INVENTION

This invention relates generally to fire suppression systems and environments which are protected against fire. More particularly, this invention relates to a protected odd-shaped environment, which may be an L-shaped room, employing a single nozzle arrangement for directing a fire-combatting chemical, such as HALON, to a plurality of preselected locations therewithin.

In conventional fire extinguisher systems of the type which are installed in buildings and other structures it is highly desirable that maximum protective coverage be achieved using minimum plumbing and number of nozzles. In addition to the expense associated with the pipe and nozzles, reduction in pipe length and number of nozzles facilitates system maintenance, as well as ensures adequate fluid pressure during system operation at remote or distal portions of the fire suppression system.

It is a characteristic of the operation of conventional fire extinguisher systems that environments having odd shapes, such as L-shaped spaces, require multiple nozzles to distribute a chemical fire-combatting fluid throughout the space, within the time periods and at the chemical concentrations required by applicable specifications, such as those established by Underwriters' Laboratories, Inc. The use of such multiple chemical nozzles, however, results in significantly increased cost, not only upon initial installation, but also in maintenance. There is, therefore, a need for a simple and economical fire suppression system which requires installation of but a single chemical discharge nozzle.

It is, therefore, an object of this invention to provide a simple and inexpensive arrangement for reducing the amount of plumbing needed in a fire extinguisher installation in an odd-shaped space.

It is another object of this invention to provide a simple odd-shaped environment which is reliably fire-protected using a single nozzle for delivering a chemical fire-combatting fluid into the space.

It is also an object of this invention to provide a simple arrangement which permits fire protection coverage to an L-shaped premises using a single nozzle which can be adjusted to cover the various portions of the premises having different dimensions.

It is a further object of this invention to provide a fire suppression arrangement which can easily be reconfigured for variations in the dimensions of the premises to be protected, and in which nozzle placement is not critical.

It is additionally an object of this invention to provide a nozzle arrangement which can distribute HALON fire suppression material in an L-shaped room using a single nozzle.

SUMMARY OF THE INVENTION

The forgoing and other objects are achieved by this invention which provides a distribution arrangement for distributing a fire suppression fluid from a supply thereof to predetermined regions of a protected space. In accordance with the invention, the distribution arrangement is provided with a coupling portion for connecting to the supply of the fire suppression fluid. A chamber wall defines a distribution chamber having an input port for communicating with the supply of the fire suppression fluid and receiving the fire suppression fluid. Additionally, the chamber wall is connected to the coupling portion. First, second, and third nozzle apertures are arranged through the chamber wall for directing the fire suppression fluid contained in the distribution chamber toward the predetermined regions of the confined space. The first and second ones of the nozzle apertures are substantially axially parallel with one another, and the third nozzle aperture is arranged substantially orthogonal with respect to the first and second nozzle apertures.

In a preferred embodiment of the invention, the coupling portion is formed integrally with the chamber wall. Moreover, the coupling portion may have threads for coupling with the supply of the fire suppression fluid, which can be in the form of a pipe. In addition, flatted portions or other structures may be provided to facilitate gripping of the distribution arrangement by a wrench. Again, this may be formed integrally with the chamber wall.

In certain embodiments of the invention, the first, second and third nozzle apertures which are arranged through the chamber wall may have a diameter of approximately between 0.0730 and 1.2500 inches, depending upon the specific application. Aperture size is not itself a limitation of the invention, and persons skilled in the art can determine the appropriate aperture sizes. Such apertures may be arranged substantially orthogonal with respect to the chamber wall.

In accordance with a further aspect of the invention, an arrangement for distributing fire suppression fluid is provided with an input port for coupling to the supply of the fire suppression fluid and a chamber which is coupled to the input port for receiving the fire suppression fluid at a predeterminable rate of supply. First, second, and third output ports are coupled to the chamber portion for directing the fire suppression fluid in the distribution chamber towards respective portions of a predetermined area, at respective ones of first, second and third output flow rates. The three output flow rates, when combined additively, represent a combined output flow rate which is limited so as not to exceed a predetermined maximum rate of supply.

The input port is provided with threaded means for coupling with the supply of the fire suppression fluid, whereby the fire suppression fluid is provided to the chamber which is formed by a chamber wall. Preferably, the chamber wall is formed integrally with the input port.

In one embodiment of the invention, the output ports are formed of first, second and third through-holes which are arranged through the chamber walls. Preferably, such throughholes are arranged to communicate with the chamber at a region thereof which is distal from the input port. In a specific illustrative embodiment, the through-holes each have a diameter approximately between 0.0730 and 1.2500 inches. This range of through-hole diameters is suitable for use in embodiments where the fire suppression fluid is of the type marketed under the trademark HALON.

As previously discussed hereinabove the arrangement of through-holes which form the output ports may be arranged in a specific orientation which facilitates fire suppression coverage of odd-shaped premises, such as L-shaped rooms. In such an embodiment, the first and second output ports are arranged substantially axially parallel to one another to deliver the fire suppression fluid in diametrically opposed directions, and the third output port is arranged substantially orthogonal thereto.

BRIEF DESCRIPTION OF THE DRAWING

Comprehension of the invention is facilitated by reading the following detailed description, in conjunction with the annexed drawing, in which.

DETAILED DESCRIPTION

Figure 1:
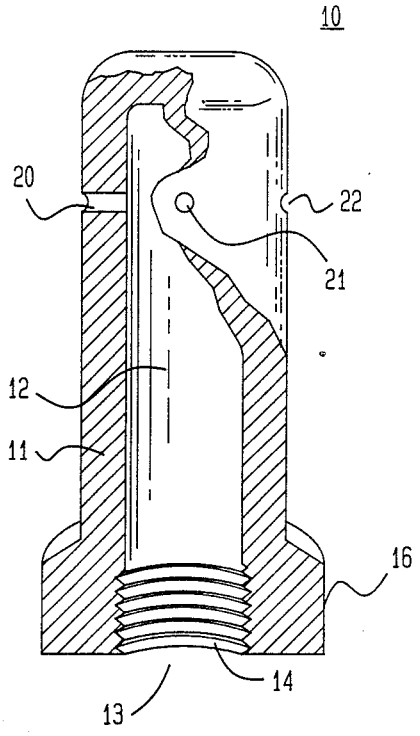
FIG. 1 is a partially fragmented isometric representation of a specific, illustrative embodiment of the nozzle of the invention.

FIG. 1 shows a distribution arrangement 10 for distributing a fire suppression fluid, such as that which is marketed under the trademark HALON. Distribution arrangement 10 is shown to be formed of a chamber wall 11 which surrounds a chamber 12. Chamber 12 is in communication with an input port 13 which is shown to be provided with threads 14.

Threads 14 permit coupling of the distribution arrangement to a supply of fire suppression fluid. Such a supply may be in the form of a threaded pipe which may be of a conventional type. The distribution arrangement is further provided with a wrench gripping portion 16 which may have flattened regions. Chamber wall 11, which is generally cylindrical on the exterior is formed integrally with the wrench gripping portion, in this specific illustrative embodiment of the invention.

A plurality of through-holes 20, 21, and 22, arranged in chamber wall 11, serve as outlet ports for the fire suppression fluid (not shown) which would be introduced into input port 13. As shown, through-holes 20 and 22 are essentially parallel to one another so as to direct the respective streams of the fire suppression fluid (not shown), in opposite directions. Through-hole 21 is substantially orthogonal to the remaining through-holes.

Figure 2:
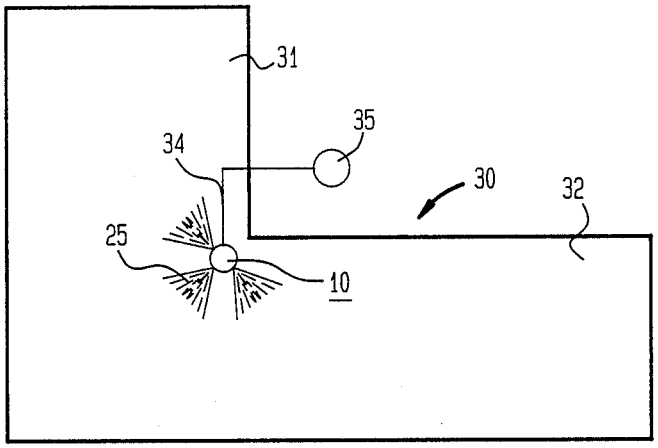
FIG. 2 is a schematic plan representation of a protected environment employing the nozzle of FIG. 1 in a predetermined orientation.

FIG. 2 is a schematic plan view of a protected environment 30 having generally an L-shape with protected regions 31 and 32. As shown in this figure, protected region 31 is wider than protected region 32. Distribution arrangement 10 is shown to be disposed in the vicinity where the protected regions meet with one another. In this specific embodiment of the invention, distribution arrangement 10, which as previously discussed is provided with three through-holes (not specifically designated in this figure), discharges fire suppression fluid 25 after triggering of the fire-combatting system (not specifically shown). The fire suppression fluid being discharged is shown schematically by the dark triangles which are joined at one point thereof to distribution arrangement 10.

In the specific illustrative embodiment of FIG. 2, protected region 31 is wider than protected region 32. Accordingly, distribution arrangement 10 is shown to be rotatively oriented within the protected environment so that the flow of fire suppression fluid 25 generally toward the protected region of greater area or volume is increased. However, it is understood that relative areas or volumes among the protected regions is not the only criteria to be considered in predetermining the directions of the discharges of the fire suppression fluid. The specific nature of the fire hazard in the protected regions may also be considered.

Distribution arrangement 10 is coupled via a pipe 34 to a supply 35 of fire suppression fluid 25. In this figure, the pipe, which functions as a coupling means, and the supply, are illustrated schematically. Supply 25 may be located anywhere within or outside of protected regions 31 and 32. Additionally, pipe 34 may be threadedly coupled to distribution arrangement 10, illustratively by means of threads 14 in input port 13, which are described hereinabove with respect to FIG. 1.

Figure 3:
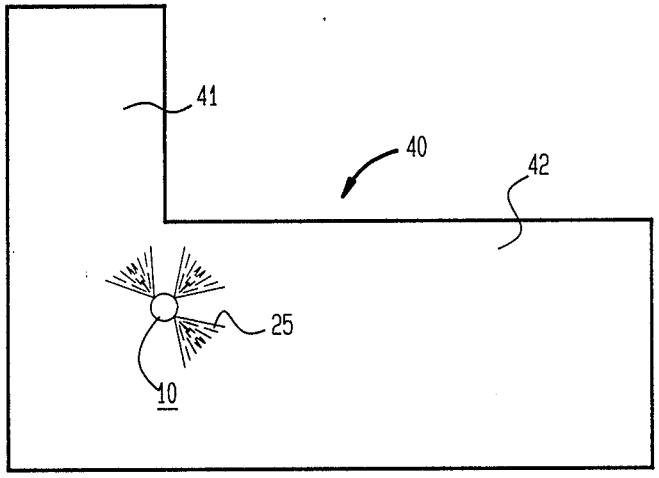
FIG. 3 is a schematic plan representation of a protected environment employing the nozzle of FIG. 1 in an alternative orientation within the scope of the present invention.

FIG. 3 is a schematic plan view of a protected environment 40 having generally an L-shape with protected regions 41 and 42. As shown in this figure, protected region 42 is wider than protected region 41. Accordingly, distribution arrangement 10 is shown to be rotatively oriented within the protected environment so that the flow of fire suppression fluid 25 generally favors the protected region of greater area or volume.

In a manner similar to that discussed hereinabove with respect to the embodiment of FIG. 2, distribution arrangement 10 in FIG. 3 is disposed in the vicinity where the protected regions meet with one another, and is shown discharging fire suppression fluid 25 during operation of the fire suppression system. The fire suppression fluid is represented schematically by the dark triangles. The distribution arrangement is rotatively oriented within the protected environment so that the flow of fire suppression fluid 25 generally favors, in this specific application, the protected region of greater area or volume.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A protected environment, comprising:

space defining means having a horizontal base member and a wall member extending substantially vertically upward from said horizontal base member, said wall member defining a substantially L-shaped area on said base member having first and second protected regions adjacent to one another;

coupling means having first and second coupling ends, said first coupling end for connecting to the supply of the fire suppression fluid, and said second coupling end being arranged within said substantially L-shaped area distal from said base member, in the vicinity where said first and second protected regions join one another; and a nozzle member coupled to said second coupling end of said coupling means, said nozzle member having a chamber wall for defining a distribution chamber having an input port for communicating with the supply of the fire suppression fluid and receiving the fire suppression fluid, and exclusively first, second, and third nozzle apertures disposed through said chamber wall for directing the fire suppression fluid in said distribution chamber toward the first and second protected regions of said substantially L-shaped area, said first and second ones of said nozzle apertures being arranged substantially axially parallel with respect to each other, and said third nozzle aperture being arranged substantially orthogonal to said first and second ones of said nozzle apertures, said chamber wall, except for said first, second, and third nozzle apertures, being impermeable.

2. The arrangement of claim 1 wherein said nozzle member is provided with a coupling portion in the vicinity of said input port for coupling to said coupling means, said coupling means and said chamber wall means being formed integrally with one another.

3. The arrangement of claim 2 wherein said coupling portion of said nozzle member comprises threaded means for coupling threadedly with said coupling means.

4. The arrangement of claim 3 wherein said nozzle member is further provided a wrench gripping portion formed integrally with said chamber wall means in the vicinity of said coupling portion for facilitating said coupling of said coupling portion with said coupling means.

5. The arrangement of claim 1 wherein each of said first, second, and third nozzle apertures disposed through said chamber wall means of said nozzle member are arranged to be substantially parallel to said base member of said space defining means, said nozzle member being rotatable upon installation on said coupling means whereby the directions toward which said nozzle apertures are directed in the protected environment are predeterminable.

6. The arrangement of claim 1 wherein each of said first, second, and third nozzle apertures are arranged substantially orthogonal to said chamber wall means of said nozzle member.

7. The arrangement of claim 1 wherein said space defining means is further provided with a ceiling member arranged to overlie said first and second protected regions.

* * * * *